US005908110A

United States Patent [19]

Hirai

[11] Patent Number: 5,908,110

[45] Date of Patent: Jun. 1, 1999

[54] TAG PIN ASSEMBLY

[75] Inventor: Tomoyuki Hirai, Chibasi, Japan

[73] Assignee: J.E. Kabushiki Kaisha, Tokyo, Japan

[21] Appl. No.: 08/933,374

[22] Filed: Sep. 19, 1997

[30] Foreign Application Priority Data

Oct. 14, 1996 [JP] Japan ..... 8-291162

[51] Int. Cl.[6] ..... B65D 85/24; B65D 63/00; B21F 9/02

[52] U.S. Cl. ..... 206/345; 24/16 PB; 140/93.2; 206/820; 292/318; 292/321

[58] Field of Search ..... 292/318–322; 24/16 PB, 17 AP, 704.2; 206/343, 345, 346, 338, 820; 140/93 A, 93.2

[56] References Cited

U.S. PATENT DOCUMENTS

| | | | |
|---|---|---|---|
| 4,137,606 | 2/1979 | Wood . | |
| 4,245,374 | 1/1981 | Suzuki . | |
| 4,495,972 | 1/1985 | Walker . | |
| 4,532,679 | 8/1985 | Scott . | |
| 4,609,218 | 9/1986 | Chevillard et al. . | |
| 4,640,320 | 2/1987 | Avison et al. . | |
| 5,038,931 | 8/1991 | Kunreuther | 206/346 |
| 5,042,535 | 8/1991 | Schlottke . | |
| 5,799,375 | 9/1998 | Fukami | 24/16 PB |

*Primary Examiner*—Bryon P. Gehman
*Attorney, Agent, or Firm*—Frishauf, Holtz, Goodman, Langer & Chick

[57] ABSTRACT

A flexible pin assembly for hooking tags includes a plurality of flexible pins arranged in parallel relation, and a connecting assembly for connecting together the plurality of flexible pins. Each of the flexible pins includes an intermediate portion made of a tough plastic fiber, an earlobe portion secured to one end of the intermediate portion, the earlobe portion including a through-hole and an engagement portion formed on an inner surface of a wall defining the through-hole, and a head portion secured to an opposite end of the intermediate portion and adapted to be inserted for engagement into the through-hole so that a loop is formed at the intermediate portion. The connecting assembly includes a first connecting member disposed at a location rearwardly of a base end portion of the earlobe portions, a first joint member for connecting the first connecting member to the earlobe portions and adapted to be cut off from the earlobe portions, a second connecting member disposed at a location rearwardly of a base end portion of the head portions, the second connecting member being arranged in parallel relation to the first connecting member, and a second joint member for connecting the second connecting member to the head portions and adapted to be cut off from the head portions.

37 Claims, 5 Drawing Sheets

TAG PIN ASSEMBLY

BACKGROUND OF THE INVENTION

This invention relates to an improvement of a tag pin assembly, and more particularly, to a flexible pin assembly for hooking merchandise price tags, quality tags, etc.

A conventional pin assembly comprises a plurality of flexible pins for hooking various merchandise tags. In general, the conventional flexible pin for hooking a tag includes an intermediate portion made of a plastic fiber and which is drawn, an earlobe portion formed on one end thereof, and a head portion formed on the other end thereof. The earlobe portion has a through-hole formed therein and an engagement means formed on the inner surface of the through-hole. The head portion has a stepped portion formed on its base end portion. The stepped portion is, in use, brought into engagement with the engagement means of the earlobe portion when the head portion is pierced into the through-hole of the earlobe portion, so that the head portion will not escape.

In the past, the above-described prior art pins were manufactured in a separated condition. In other words, the pins were individually manufactured, and were not manufactured as a unit or assembly of pins. In use, the pins were manually pierced, one by one, into holes of given merchandise tags, and then the head portions were manually fixedly fitted into the earlobe portions, respectively, by the user. This manual work is not efficient. In addition, use thereof often caused the user to suffer from tendovaginitis, etc.

In view of the above, many attempts have recently been made to manufacture the tag pins as a unit or assembly in which a plurality of pins are arranged in parallel relation and are connected together by a connecting member. Such unit tag pins have been mounted on a mounting device and separated by a cutter provided on the mounting device, so that the pins could be individually attached to given merchandise tags.

However, the above conventional devices still had the following shortcomings. Since the unit pins are usually connected together at one end (either the head side or the earlobe side) by the connecting member, positioning and aligning the head portions with respect to the corresponding earlobe portions is difficult. Also, it sometimes happens that the unit pins are separated before attachment to merchandise tags. Moreover, the head portions and the earlobe portions, which are mounted on a mounting device tend to spread apart from each other due to stiffness of the intermediate portion. In addition, the head portion readily escapes from the earlobe portion merely by pulling, if the length dimension of the head portion is not large enough.

The present invention has been accomplished to overcome the above-described disadvantages of the prior art.

SUMMARY OF THE INVENTION

It is therefore an object of the present invention to provide a tag pin assembly which is easy to handle, efficient in workability, favorable in production yield, and which does not readily or easily escape from a predetermined position once attached to given merchandise.

In order to achieve the above objects, a flexible tag pin assembly of the present invention for hooking tags, comprises a plurality of flexible pins arranged in parallel relation and connected together through connecting members. Each of the flexible pins includes an intermediate portion made of a tough plastic fiber, the intermediate portion being provided at a first end thereof with an earlobe portion having a through-hole and an engagement portion formed inside the through-hole, and at a second end thereof with a head portion adapted to be inserted for engagement into the through-hole of the earlobe portion so that a loop is formed by the intermediate portion. The connecting members are disposed at two places, first at a location rearwardly of a base end portion of the earlobe portion and second at a location rearwardly of a base end portion of the head portion, and connected together in parallel relation through joint members which can be cut off.

By virtue of the flexible pin assembly for hooking tags according to the present invention as constructed in the manner described above, the pins can be connected together in a comparatively stable manner, workability is improved, the pins are not readily spread apart when they are mounted on a mounting device, a comparatively stable mounting condition can be obtained, and there is no worry about escape once the pins are attached to given merchandise items.

It is preferred that the length of the head portion is generally equal to the depth of the through-hole of the earlobe portion.

The engagement members formed on the inner surface of the through-hole of the earlobe portion may be a pair of claws, and a leading end face of each of the claws is preferably slanted in a same direction and is defined by a concavely arcuate surface.

Further, an attachment member may be provided which has a ring at a distal end thereof for preventing the flexible pins as a whole from deforming when they are mounted on a mounting device. The attachment member is preferably disposed at one extreme side of the pins which are arranged in parallel relation.

One end of the intermediate portion forming the loop may be connected to an upper end of the earlobe portion at a location offset rearwardly thereof.

The earlobe portion is preferably provided with a groove formed in an outer side surface thereof, so that a drawing device can be engaged in the groove.

It is also preferred that the head portion be provided with a step component portion, and that the step component portion be integrally connected to a connecting member through a joint member. A distal end of the joint member is preferably reduced in diameter.

The above objects should be construed as being merely illustrative of some of the more prominent features and applications of the present invention. Many other beneficial results can be obtained by applying the disclosed invention in a different manner or by modifying the disclosed invention within the scope of the appended claims. Accordingly, other objects, realized with a full understanding of the present invention, may be achieved by referring to the detailed description of the preferred embodiment, within the scope of the disclosed invention defined by the appended claims, taken in conjunction with the accompanying drawings.

DETAILED DESCRIPTION OF THE PREFERRED EMBODIMENTS

One preferred embodiment of a flexible pin assembly for hooking merchandise price tags, quality tags and the like, according to the present invention will now be described in detail with reference to the accompanying drawings which constitute a part of this specification.

Figure 1:
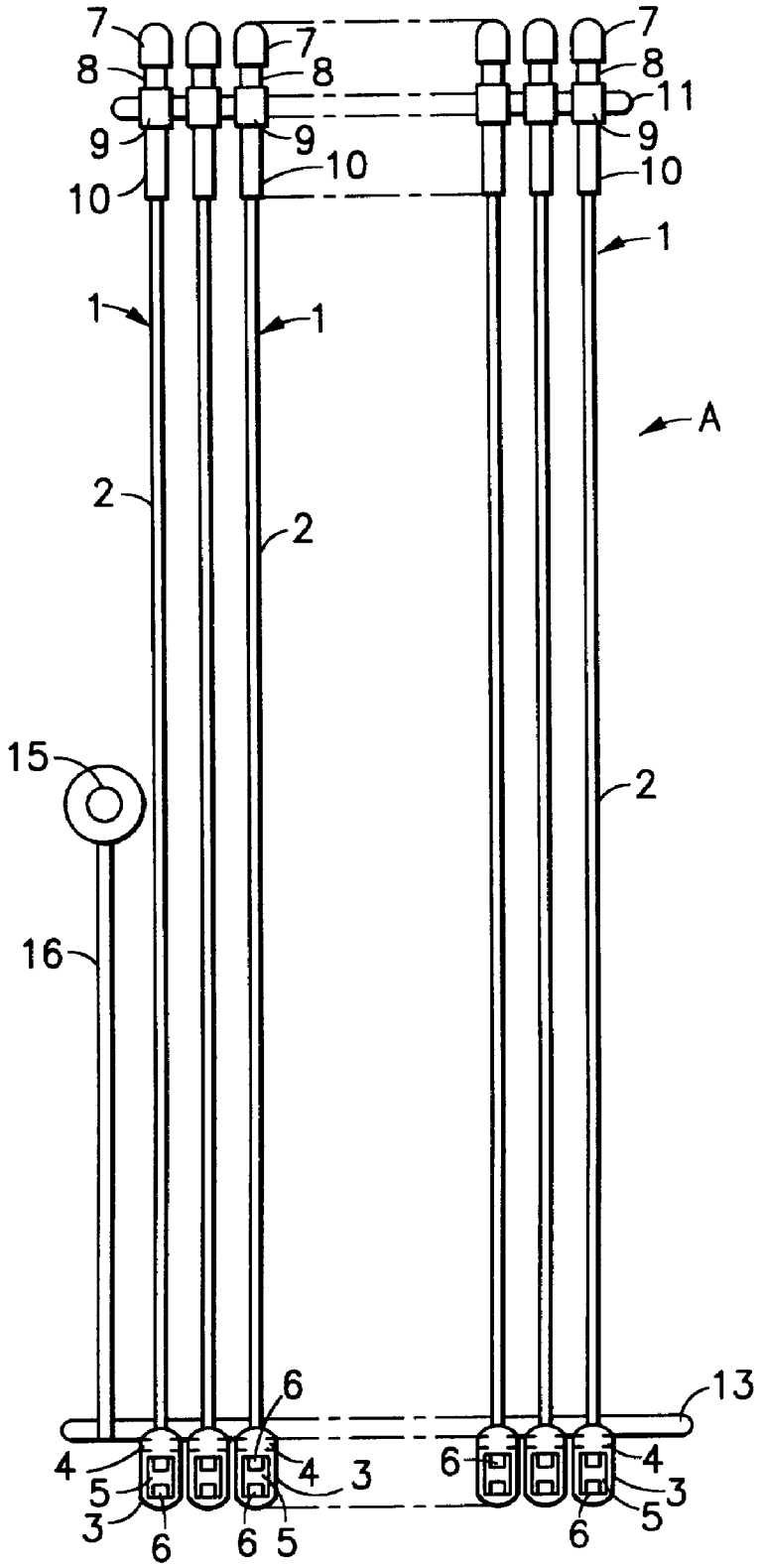
FIG. 1 is a front view showing a flexible tag pin assembly comprising a plurality of pins designed for hooking merchandise tags, according to one preferred embodiment of the present invention.
Figure 2:
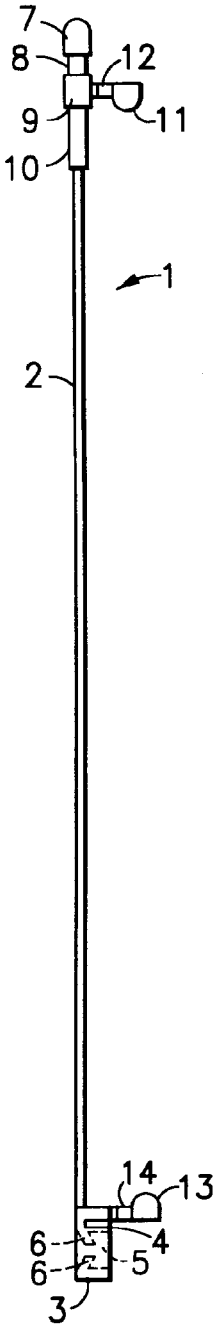
FIG. 2 is a side view of the flexible tag pin assembly of FIG. 1.
Figure 3:
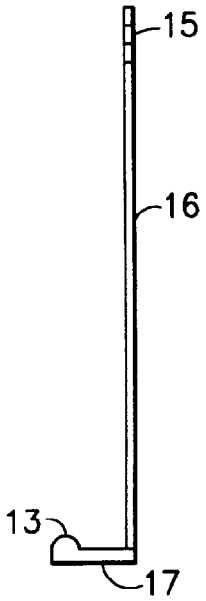
FIG. 3 is a side view of an attachment member of the flexible tag pin assembly of FIG. 1.

In FIG. 1, a flexible tag pin assembly of the present invention is generally denoted by reference character A. Tag pin assembly A is comprised of a plurality of flexible tag pins 1. Each tag pin 1 includes an intermediate portion 2 made of a tough plastic fiber, such as polypropylene or NYLON, which is drawn.

Intermediate portion 2 has an earlobe portion 3 integrally formed on one end of intermediate portion 2. Earlobe portion 3 is of a generally parallelepiped configuration, having an upper and a lower arcuate surface. The above-mentioned end of intermediate portion 2 is joined with the upper arcuate surface of earlobe portion 3 at a position near the rear edge of earlobe portion 3. A groove 4 is formed in an outer side surface of earlobe portion 3. Groove 4 is designed such that a drawing device is engageable in groove 4 when the drawing device is used for drawing intermediate portion 2. Engagement of the drawing device in groove 4 prevents an insertion hole, as later described, which is formed in the earlobe portion 3 from being longitudinally deformed.

Figure 7:
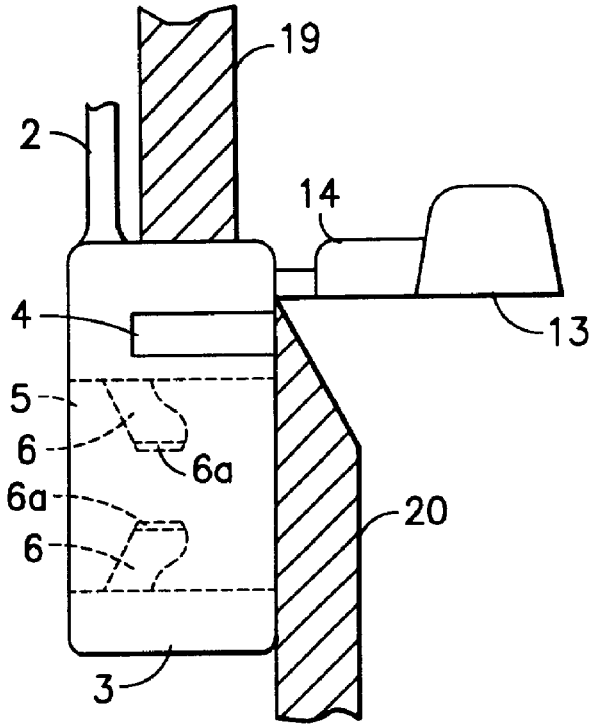
FIG. 7 is a side view showing a working condition of the earlobe portion.
Figure 8:
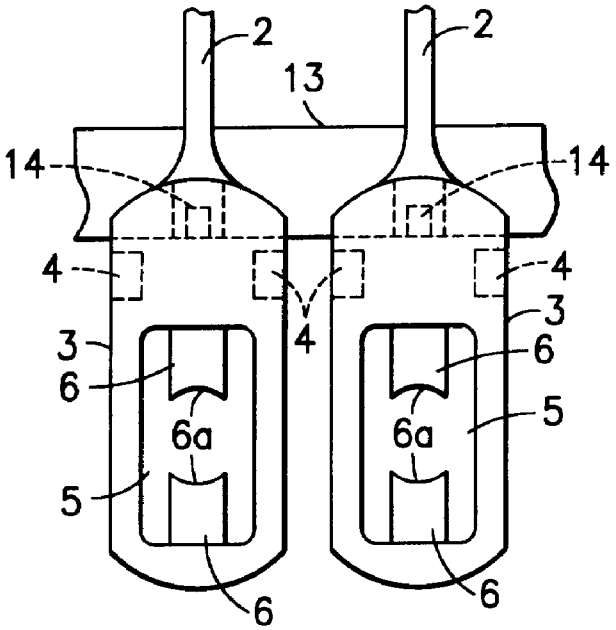
FIG. 8 is a front view of the earlobe portion.

A generally square or rectangular through-hole 5 is formed in earlobe portion 3 such that through-hole 5 extends in a forward and backward direction all the way through earlobe portion 3. A pair of opposing engagement portions 6 are formed at an upper and a lower inner surface which define through-hole 5. A leading end face 6*a* of each engagement portion 6 is defined by a concavely arcuate surface, so that a piercing portion, as later described, can easily be received. The pair of opposing engagement portions 6 are slanted, as best shown in FIG. 7, in a direction of insertion of the piercing portion in order to facilitate insertion of the piercing portion.

Reference numeral 7 denotes a piercing portion, which is, in use, pierced into earlobe portion 3. Piercing portion 7 has a round distal end face so that it can easily be passed between the pair of engagement portions 6. The length of piercing portion 7 is dimensioned as being generally equal to the depth of the through-hole 5, so that piercing portion 7, when once fixedly fitted, will not escape.

A twisted portion 8 is formed at a base end of piercing portion 7. Twisted portion 8 comes into engagement between engagement portions 6 after piercing portion 7 passes therethrough against their resiliency, so that piercing portion 7 will not escape, not only in a forward direction but also in a backward direction.

There is a provision of a step component portion 9 which is continuous with twisted portion 8. There is also a provision of a reinforcing enlarged-diameter portion 10 which is continuous with step component portion 9.

Figure 5:
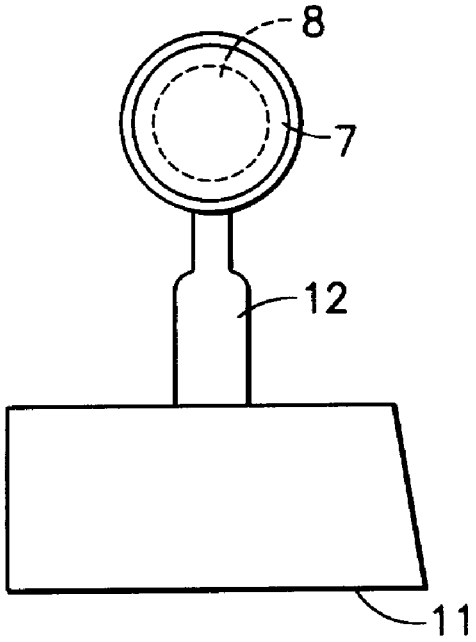
FIG. 5 is a front view of the push portion of FIG. 4.

A first connecting member 11 having a generally semi-cylindrical configuration in cross-section is disposed across step component portions 9 of flexible pins 1. First connecting member 11 and step component portions 9 are connected together through a joint member 12 which is reduced in diameter at its base end, as best shown in FIG. 5. Opposite ends of first connecting member 11 slightly project outwardly from the two tag pins 1 which are located at the left and right extreme sides of tag pin assembly A.

Figure 6:
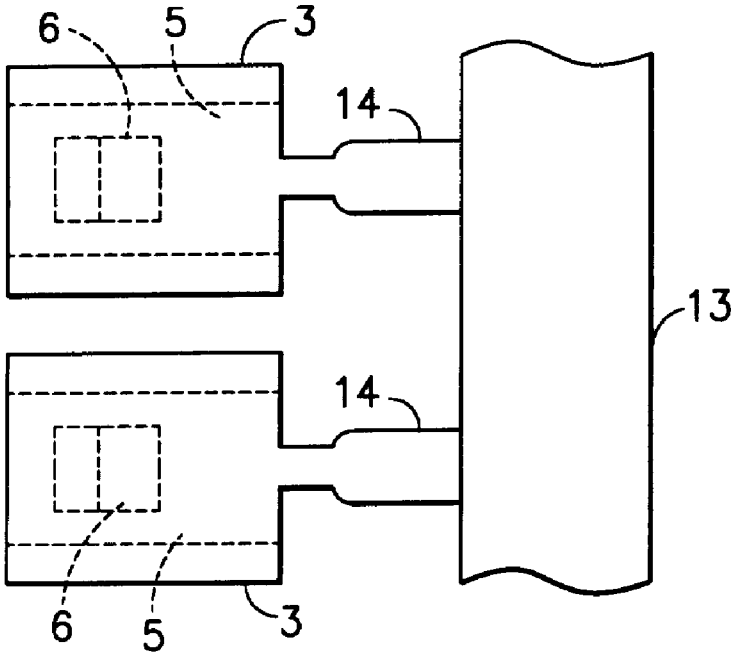
FIG. 6 is an enlarged plan view of earlobe portions of flexible tag pins which constitute a part of the flexible tag pin assembly of FIG. 1.

A second connecting member 13 having a semi-cylindrical configuration in cross-section is likewise disposed across earlobe portions 3 at locations offset toward the upper ends of the rear surfaces of earlobe portion 3, that is, rearwardly of earlobe portions 3 such that second connecting member 13 is in parallel relation with first connecting member 11. Due to this arrangement, a cutting function of a cutter, as later described, can be executed in an efficient manner. Second connecting member 13 is likewise integrally connected to earlobe portions 3 through joint members 14, as best shown in FIG. 6. Opposite ends of second connecting member 13 slightly project, as with first connecting member 11, from outwardly the two tag pins 1 which are located at the left and right extreme sides of tag pin assembly A.

Figure 9:
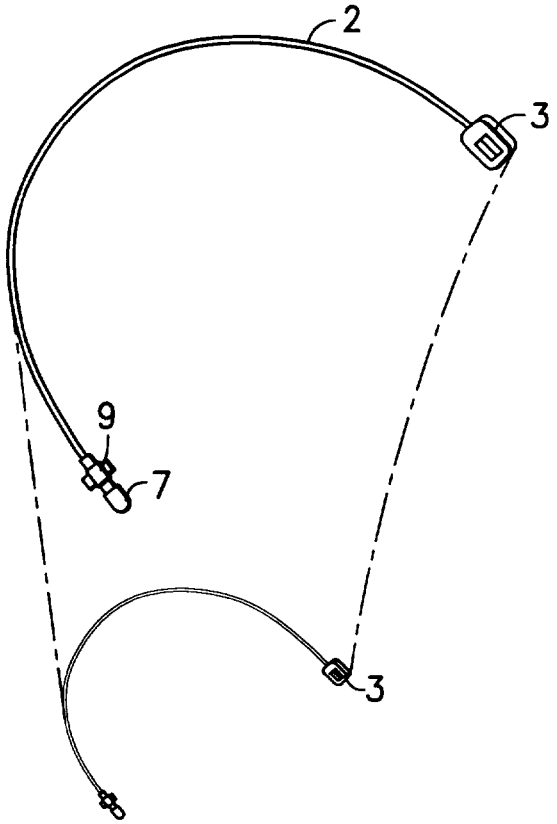
FIG. 9 is a perspective view of conventional flexible tag pins in which the head portions and the earlobe portions are mounted on a mounting device.
Figure 10:
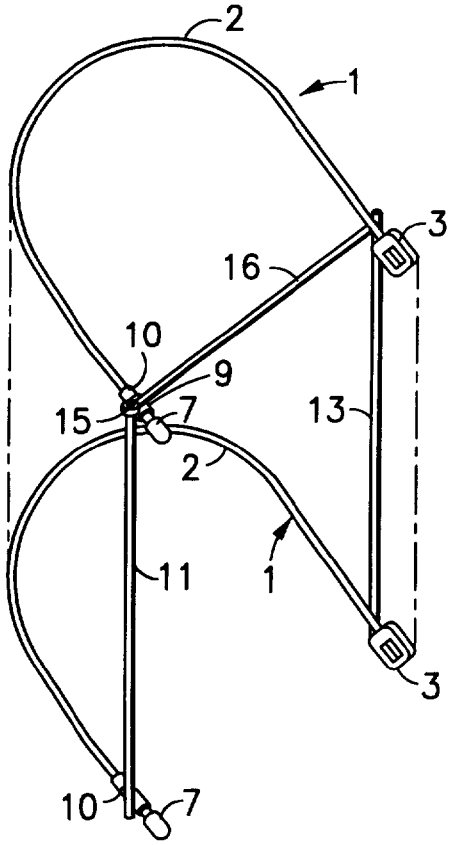
FIG. 10 is a perspective view of flexible tag pins according to the present invention, in which the head portions and the earlobe portions are mounted on a mounting device.

An attachment member 16 having an attachment ring 15 at its distal end is mounted on one end of second connecting member 13 through a joint member 17 such that attachment member 16 extends in the same direction as, and is in parallel relation with, tag pins 1. Attachment member 16 is adapted to prevent the unsupported upper parts of tag pins 1 from spreading apart, as often experienced (see FIG. 9) in the prior art devices, when the tag pins are mounted on a mounting device (not shown). In order to prevent the unsupported upper parts of tag pins 1 from spreading apart, as shown in FIG. 10, attachment ring 15 is fitted to one end of first connecting member 11. By doing so, a smooth handling of tag pin assembly A can be obtained.

Figure 4:
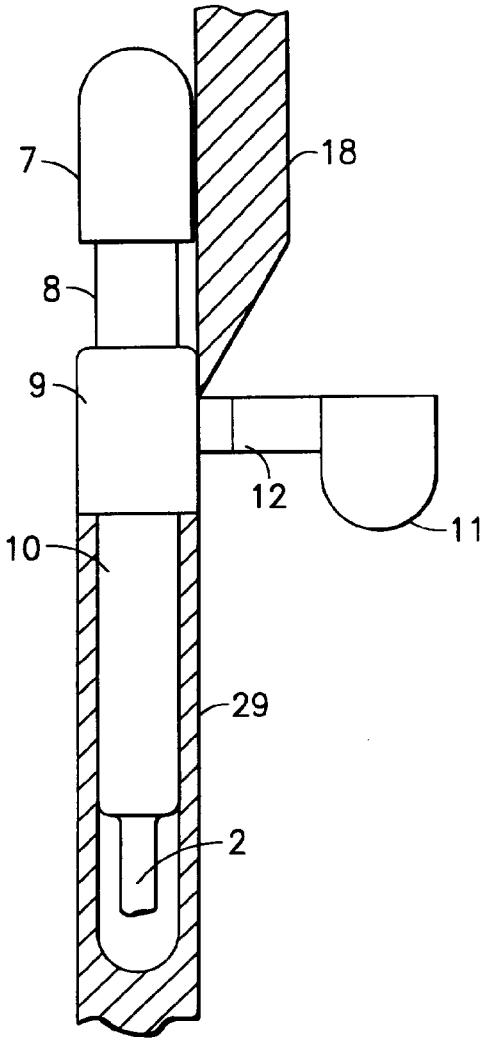
FIG. 4 is an enlarged view of a push portion of the flexible tag pin assembly of FIG. 1.

A flexible pin assembly for hooking merchandise tags according to one embodiment of the present invention is constructed in the manner as mentioned hereinbefore. Tag pins 1, which are connected together through first and second connecting members 11 and 13, are mounted on the mounting device, and then attached, one by one, to given merchandise items by means of a lever. As shown in FIG. 4, the rear side of step component portion 9 is pushed into the through-hole 5 of earlobe portion 3 by a piston rod 29 which is mounted on head portion 7, so as to pass between engagement portions 6. At that time, joint member 12 of first connecting member 11 is cut off at its base end by a cutter 18.

On the other hand, earlobe portion 3 is guided and correctly positioned by a belt 19 mounted on the mounting device. The joint member 14 for second connecting member 13 is cut off its base end by another cutter 20, so that tag pins 1 can be used individually and independently.

A flexible tag pin assembly according to the present invention is constructed and used in the manner as mentioned above. Therefore, it can more easily be handled in comparison with the prior art devices. Moreover, workability is improved. In addition, there is no fear of escape once the tag pins of the present invention are attached to given merchandise items.

It should be understood that the specific embodiment of the present invention shown and described herein is merely a preferred embodiment of the same, and that various changes in shape, size and arrangement of the structural features thereof may be resorted to without departing from the spirit and scope of the present invention as defined in the appended claims.

What is claimed is:

1. A flexible pin assembly for hooking tags, comprising:

i) a plurality of flexible pins arranged in parallel relation, each of said flexible pins including:

an intermediate portion, an earlobe portion secured to a first end of said intermediate portion, said earlobe portion including a through-hole and an engagement portion formed on an inner surface of a wall defining said through-hole, and a head portion secured to a second end of said intermediate portion opposite said first end, said head portion being adapted to be inserted for engagement into said through-hole of said earlobe portion so that a loop is formed by said intermediate portion;

ii) a connecting assembly for connecting together the plurality of flexible pins, said connecting assembly including:

a first connecting member disposed proximate a base end portion of said earlobe portions, a first joint member for connecting said first connecting member to said earlobe portions and adapted to be cut off from said earlobe portions, a second connecting member disposed proximate a base end portion of said head portions, said second connecting member being arranged in parallel relation to said first connecting member, and a second joint member for connecting said second connecting member to said head portions and adapted to be cut off from said head portions; and iii) an attachment member coupled to the connecting assembly having a ring at a distal end thereof for preventing said flexible pins as a whole from deforming when said flexible pins are mounted on a mounting device, said attachment member being disposed at one extreme side of said pins which are arranged in said parallel relation.

2. A flexible pin assembly for hooking tags according to claim 1, wherein said head portion has a length which is approximately equal to a depth of said through-hole of said earlobe portion.

3. A flexible pin assembly for hooking tags according to claim 2, wherein said engagement portion of said earlobe portion includes a pair of claws, a leading end face of each of said claws being slanted in a same direction, and each said leading face being defined by a concavely arcuate surface.

4. A flexible pin assembly for hooking tags according to claim 2, wherein said one end of said intermediate portion forming the loop is connected to an upper end of said earlobe portion at a location offset from of said earlobe portion.

5. A flexible pin assembly for hooking tags according to claim 2, wherein said earlobe portion includes an outer surface with a groove formed in the outer side surface thereof for engagement of a drawing device in said groove.

6. A flexible pin assembly for hooking tags according to claim 2, wherein said head portion is provided with a step component portion, said step component portion being integrally connected to said second connecting member through said second joint member.

7. A flexible pin assembly for hooking tags according to claim 2, wherein a distal end of each said joint member is reduced in diameter.

8. A flexible pin assembly for hooking tags according to claim 1, wherein said engagement portion of said earlobe portion includes a pair of claws, a leading end face of each of said claws being slanted in a same direction, and each said leading face being defined by a concavely arcuate surface.

9. A flexible pin assembly for hooking tags according to claim 8, wherein said one end of said intermediate portion forming the loop is connected to an upper end of said earlobe portion at a location offset from of said earlobe portion.

10. A flexible pin assembly for hooking tags according to claim 8, wherein said earlobe portion includes an outer surface with a groove formed in the outer side surface thereof for engagement of a drawing device in said groove.

11. A flexible pin assembly for hooking tags according to claim 1, wherein said one end of said intermediate portion forming the loop is connected to an upper end of said earlobe portion at a location offset from of said earlobe portion.

12. A flexible pin assembly for hooking tags according to claim 11, wherein said earlobe portion includes an outer surface with a groove formed in the outer side surface thereof for engagement of a drawing device in said groove.

13. A flexible pin assembly for hooking tags according to claim 1, wherein said earlobe portion includes an outer surface with a groove formed in the outer side surface thereof for engagement of a drawing device in said groove.

14. A flexible pin assembly for hooking tags according to claim 1, wherein said head portion is provided with a step component portion, said step component portion being integrally connected to said second connecting member through said second joint member.

15. A flexible pin assembly for hooking tags according to claim 1, wherein a distal end of each of said first and second joint members is reduced in diameter.

16. A tag pin assembly comprising:

a plurality of fasteners, each fastener having a filament, a plug at one end of the filament and a socket at the other end of the filament;

a pair of runner bars, one runner bar being connected to the plugs of the plurality of fasteners, and the other runner bar being connected to the sockets of the plurality of fasteners; and an attachment member coupled to one of the runner bars having a ring at a distal end thereof for preventing said fasteners as a whole from deforming when said fasteners are mounted on a mounting device, said attachment member being disposed at one extreme side of said fasteners.

17. A tag pin assembly comprising:

a plurality of fasteners, each fastener having a filament, a plug at one end of the filament and a socket at the other end of the filament, said fasteners being disposed in a plane;

a pair of runner bars connected to one end of each fastener and spaced from the plane of the fasteners; and an attachment member coupled to one of the runner bars and having a ring at a distal end thereof for preventing said fasteners as a whole from deforming when said fasteners are mounted on a mounting device, said attachment member being disposed at one extreme side of said fasteners.

18. A tag pin assembly comprising:

a plurality of fasteners, each fastener having a filament, a plug at one end of the filament and a socket at the other end of the filament, said socket having an outer end and an inner end;

a runner bar connected to the socket of each fastener at a location spaced inward from the outer end of each socket; and an attachment member coupled to the runner bar and having a ring at a distal end thereof for preventing said fasteners as a whole from deforming when said fasteners are mounted on a mounting device, said attachment member being disposed at one extreme side of said fasteners.

19. A flexible pin assembly for hooking tags, comprising:

i) a plurality of flexible pins arranged in parallel relation, each of said flexible pins including:

an intermediate portion, an earlobe portion secured to a first end of said intermediate portion, said earlobe portion including a through-hole and an engagement portion formed on an inner surface of a wall defining said through-hole, and a head portion secured to a second end of said intermediate portion opposite said first end, said head portion being adapted to be inserted for engagement into said through-hole of said earlobe portion so that a loop is formed by said intermediate portion; and ii) a connecting assembly for connecting together the plurality of flexible pins, said connecting assembly including:

a first connecting member proximate a base end portion of said earlobe portions, a first joint member for connecting said first connecting member to said earlobe portions and adapted to be cut off from said earlobe portions, a second connecting member disposed proximate a base end portion of said head portions, said second connecting member being arranged in parallel relation to said first connecting member, and a second joint member for connecting said second connecting member to said head portions and adapted to be cut off from said head portions;

wherein said earlobe portion includes an outer surface with a groove formed in the outer side surface thereof for engagement of a drawing device in said groove.

20. A flexible pin assembly for hooking tags according to claim 19, wherein said head portion has a length which is approximately equal to a depth of said through-hole of said earlobe portion.

21. A flexible pin assembly for hooking tags according to claim 20, wherein said engagement portion of said earlobe portion includes a pair of claws, a leading end face of each of said claws being slanted in a same direction, and each said leading face being defined by a concavely arcuate surface.

22. A flexible pin assembly for hooking tags according to claim 20, further comprising an attachment member having a ring at a distal end thereof for preventing said flexible pins as a whole from deforming when said flexible pins are mounted on a mounting device, said attachment member being disposed at one extreme side of said pins which are arranged in said parallel relation.

23. A flexible pin assembly for hooking tags according to claim 20, wherein said one end of said intermediate portion forming the loop is connected to an upper end of said earlobe portion at a location offset from said earlobe portion.

24. A flexible pin assembly for hooking tags according to claim 20, wherein said head portion is provided with a step component portion, said step component portion being integrally connected to said second connecting member through said second joint member.

25. A flexible pin assembly for hooking tags according to claim 20, wherein a distal end of each said joint member is reduced in diameter.

26. A flexible pin assembly for hooking tags according to claim 19, wherein said engagement portion of said earlobe portion includes a pair of claws, a leading end face of each of said claws being slanted in a same direction, and each said leading face being defined by a concavely arcuate surface.

27. A flexible pin assembly for hooking tags according to claim 26, further comprising an attachment member having a ring at a distal end thereof for preventing said flexible pins as a whole from deforming when said flexible pins are mounted on a mounting device, said attachment member being disposed at one extreme side of said pins which are arranged in said parallel relation.

28. A flexible pin assembly for hooking tags according to claim 26, wherein said one end of said intermediate portion forming the loop is connected to an upper end of said earlobe portion at a location offset from said earlobe portion.

29. A flexible pin assembly for hooking tags according to claim 19, further comprising an attachment member having a ring at a distal end thereof for preventing said flexible pins as a whole from deforming when said flexible pins are mounted on a mounting device, said attachment member being disposed at one extreme side of said pins which are arranged in said parallel relation.

30. A flexible pin assembly for hooking tags according to claim 29, wherein said one end of said intermediate portion forming the loop is connected to an upper end of said earlobe portion at a location offset from said earlobe portion.

31. A flexible pin assembly for hooking tags according to claim 19, wherein said one end of said intermediate portion forming the loop is connected to an upper end of said earlobe portion at a location offset from said earlobe portion.

32. A flexible pin assembly for hooking tags according to claim 31, wherein said earlobe portion includes an outer surface with a groove formed in the outer side surface thereof for engagement of a drawing device in said groove.

33. A flexible pin assembly for hooking tags according to claim 19, wherein said head portion is provided with a step component portion, said step component portion being integrally connected to said second connecting member through said second joint member.

34. A flexible pin assembly for hooking tags according to claim 19, wherein a distal end of each of said first and second joint members is reduced in diameter.

35. A tag pin assembly comprising:

a plurality of fasteners, each of said fasteners including:

an intermediate portion, an earlobe portion secured to a first end of said intermediate portion, said earlobe portion including a through-hole and an engagement portion formed on an inner surface of a wall defining said through-hole, and a head portion secured to a second end of said intermediate portion opposite said first end, said head portion being adapted to be inserted for engagement into said through-hole of said earlobe portion so that a loop is formed by said intermediate portion; and a pair of runner bars, one runner bar being connected to the head portion of the plurality of fasteners, and the other runner bar being connected to the earlobe portion of the plurality of fasteners;

wherein said earlobe portion includes an outer surface with a groove formed in the outer side surface thereof for engagement of a drawing device in said groove.

36. A tag pin assembly comprising:

a plurality of fasteners being disposed in a plane, each of said fasteners including:

an intermediate portion, an earlobe portion secured to a first end of said intermediate portion, said earlobe portion including a through-hole and an engagement portion formed on an inner surface of a wall defining said through-hole, and a head portion secured to a second end of said intermediate portion opposite said first end, said head portion being adapted to be inserted for engagement into said through-hole of said earlobe portion so that a loop is formed by said intermediate portion; and a pair of runner bars connected to one end of each fastener and spaced from the plane of fasteners;

wherein said earlobe portion includes an outer surface with a groove formed in the outer side surface thereof for engagement of a drawing device in said groove.

37. A tag pin assembly comprising:

a plurality of fasteners arranged in parallel relation, each of said fasteners including:

an intermediate portion, an earlobe portion secured to a first end of said intermediate portion, said earlobe portion including a through-hole and an engagement portion formed on an inner surface of a wall defining said through-hole, said through-hole having an outer end and an inner end, and a head portion secured to a second end of said intermediate portion opposite said first end, said head portion being adapted to be inserted for engagement into said through-hole of said earlobe portion so that a loop is formed by said intermediate portion; and a runner bar connected to the through-hole of each fastener and being interposed between the through-hole and the head portion;

wherein said earlobe portion includes an outer surface with a groove formed in the outer side surface thereof for engagement of a drawing device in said groove.

* * * * *